US006321648B1

(12) United States Patent
Berson et al.

(10) Patent No.: US 6,321,648 B1
(45) Date of Patent: Nov. 27, 2001

(54) SYSTEMS AND METHODS FOR UNFORGEABLE DOCUMENT TAGGING

(75) Inventors: Thomas A. Berson, Palo Alto; Thomas M. Breuel, Brisbane, both of CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/504,036

(22) Filed: Feb. 14, 2000

(51) Int. Cl.[7] ..... B31F 1/07
(52) U.S. Cl. ..... 101/32; 101/401.1; 101/23
(58) Field of Search ..... 101/23, 24, 32, 101/6, 375, 401, 401.1

(56) References Cited

U.S. PATENT DOCUMENTS 3,915,090 * 10/1975 Horst et al. ..... 101/32
3,924,313 * 12/1975 Broderick .
3,936,384 * 2/1976 Williams ..... 101/32
4,200,389 * 4/1980 Matsui et al. .
4,586,431 * 5/1986 Calman ..... 101/32
5,042,383 * 8/1991 Wirz ..... 101/420
5,666,191 * 9/1997 Hasegawa ..... 399/366
6,015,600 * 1/2000 Greuel, Jr. et al. ..... 428/34.9
6,212,504 * 4/2001 Hayosh ..... 705/64

FOREIGN PATENT DOCUMENTS 0 089 746 A2 9/1983 (EP) .

* cited by examiner

*Primary Examiner*—Eugene Eickholt
(74) *Attorney, Agent, or Firm*—Oliff & Berridge, PLC

(57) ABSTRACT

A system and method for tagging sheets of recording material, so that the origin of the sheets and the authenticity of the sheets may be determined, includes a roller that applies at least a portion of the random pattern to the document. The random pattern is applied by imprinting, embossing, or by piercing the sheet. The pattern applied to the sheet can be determined by any known forensic technique and the pattern can be imaged and stored in a database. A series of rollers may apply phase shifted random patterns to one side or both sides of the sheet. The phase shift of the random patterns may be determined to establish a sequence code. The roller or rollers including the random patterns may be installed in an image forming apparatus, preferably in a sheet transport mechanism of the image forming apparatus.

19 Claims, 9 Drawing Sheets

SYSTEMS AND METHODS FOR UNFORGEABLE DOCUMENT TAGGING

BACKGROUND OF THE INVENTION

1. Field of Invention

This invention relates generally to document creation that allows for tracing the origin of the document and verifying the authenticity of a document.

2. Description of Related Art

It is often desirable to be able to trace the origin and to verify the authenticity of a document. Documents, such as currency, bearer bonds, and stock certificates, may be forged by scanning an image of the document and producing a copy of the document from the scanned image. Current methods available for tracing the origin of a document or verifying its authenticity include pseudo-random iridescent spots applied to the document during printing, and data glyphs or digital watermarks formed in the document during printing. These methods rely on the secrecy of the underlying encoding algorithm used to encode the identifying marks. If the encoding algorithm is decoded, a forger can create copies of the documents that are indistinguishable from the authentic documents. The use of an encoding algorithm to apply identifying marks to a document also increases the complexity of the printer software.

Other methods of tracing the origin of a document or verifying its authenticity include water marks, iridescent planchettes, luminescent inks and fibers, and chemical reagents applied to the paper. All of these methods, however, require the use of special paper or treatments for the paper which increase the cost of creating the document.

SUMMARY OF THE INVENTION

This invention provides systems and methods that tag documents by applying a random pattern to the document during printing. In one exemplary embodiment of the systems and methods of the invention, a roller includes a random pattern on its outer surface. The roller applies at least a portion of the random pattern to the document as the document passes through a nip formed between the roller and another roller that does not have a random pattern on its outer surface. The roller with the random pattern on its outer surface is formed of a material having a random granular structure. The random pattern formed on the outer surface of the roller is unique and nearly impossible to duplicate. The pattern applied to the document is out-of-band, meaning the pattern is not visual and cannot be reproduced by conventional image reproduction systems. The random pattern applied to the document can be detected and its representation can be stored in a database.

In other exemplary embodiments of the systems and methods of the invention, first and second rollers, each including a unique random pattern on its outer surface, form a nip and apply the random patterns to both sides of the document as it passes through the nip.

In other exemplary embodiments of the systems and methods of the invention, a circumference of the roller or rollers that apply the random pattern or patterns is larger than a length of the sheet of recording material on which a page of the document is printed so that only a portion of the random pattern or patterns is applied to any single page of the document.

In other exemplary embodiments of the systems and methods of the invention, a circumference of the roller or rollers that apply the random pattern or patterns is smaller than a length of the sheet of recording material on which a page of the document is printed so that the random pattern or patterns are applied more than once to any single page of the document.

In other exemplary embodiments of the systems and methods of the invention, a series of rollers that each applies a unique random pattern to the document are provided, to apply the unique random patterns to the document in a phase-shifted relationship.

In other exemplary embodiments of the systems and methods of the invention, phase shifted random patterns may be applied to both sides of the document.

In other exemplary embodiments of the systems and methods of the invention, a non-random pattern may also be formed on the outer surface of the roller, in addition to the random pattern formed on the outer surface.

These and other features of the invention will be described in or are apparent from the following detailed description of various exemplary embodiments of systems and methods according to this invention.

BRIEF DESCRIPTION OF THE DRAWINGS

Various exemplary embodiments of systems and methods according to this invention will be described with reference to the following drawings, wherein.

DETAILED DESCRIPTION OF PREFERRED EMBODIMENTS

Figure 1:
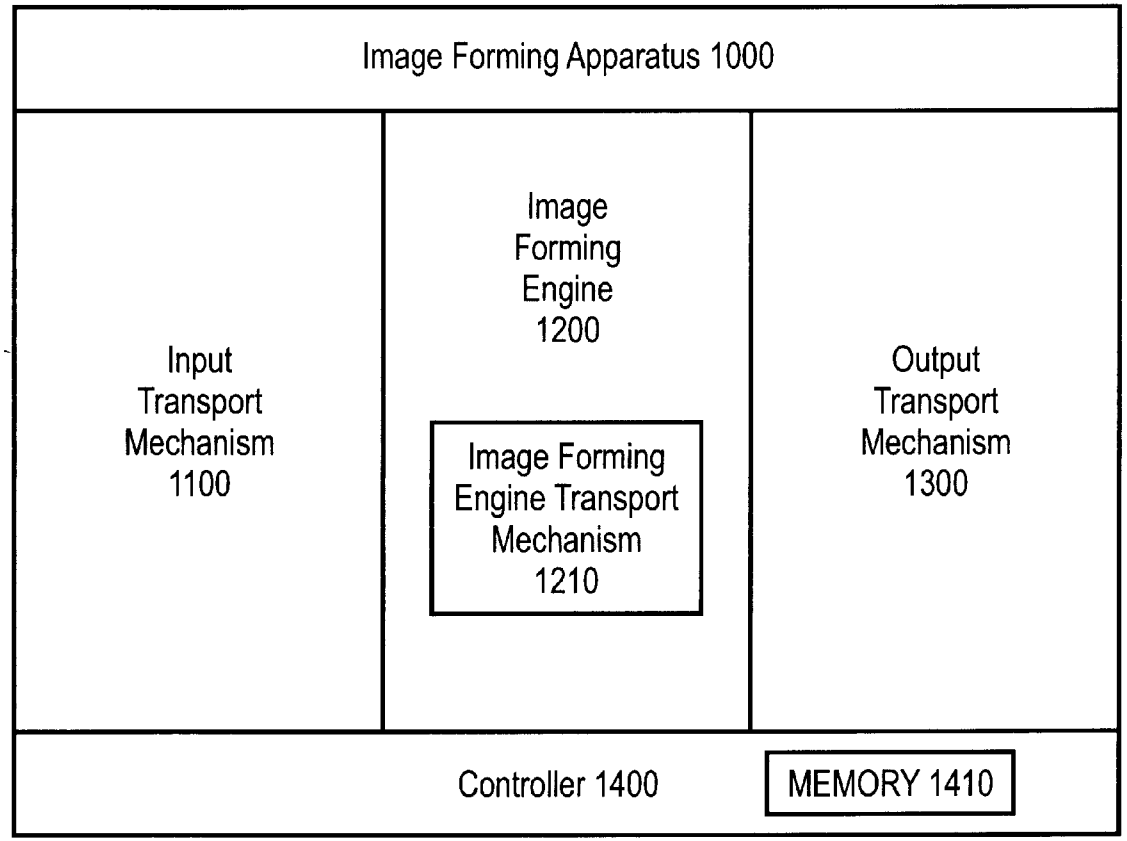
FIG. 1 is a block diagram illustrating an image forming apparatus.

FIG. 1 is a block diagram illustrating an image forming apparatus 1000. The image forming apparatus 1000 may be, for example a laser printer, a copier, or an ink jet printer. The image forming apparatus 1000 includes an input transport mechanism that transports sheets of recording material from a supply of sheets of recording material to an image forming engine 1200. The sheets of recording material are transported through the image forming engine 1200 by an image forming engine transport mechanism 1210. An output transport mechanism 1300 transports the sheets of recording material from the image forming engine 1200 to a collection site. A controller 1400 controls the input transport mechanism 1100, the image forming engine 1200, the image forming engine transport mechanism 1210, and the output transport mechanism of the image forming apparatus 1000.

Figure 2:
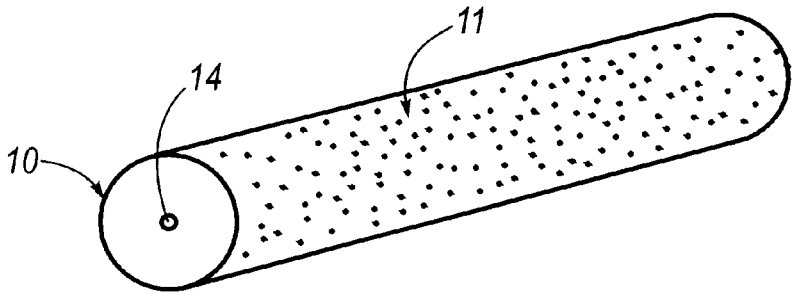
FIG. 2 is a perspective view of a first exemplary embodiment of a roller including a random pattern on an outer surface.

FIG. 2 shows one exemplary embodiment of a roller 10 having a random pattern according to this invention. As shown in FIG. 2, the roller 10 includes an outer surface 11 having a random pattern. In various exemplary embodiments, the roller 10 is formed of a material which has a random granular structure. The roller 10 may be formed of ceramic, cast steel, plastic, or glass. The random pattern on the outer surface 11 may include large rounded grains, small rounded grains, or sharp splinters. Although the random pattern is formed by the random granular structure of the material forming the roller 10, it should be appreciated that, in other exemplary embodiments, a random pattern may be applied to the outer surface of the roller 10 by a process such as sand blasting or any other machining technique that produces a random pattern. A shaft 14 passes through the roller 10 and is generally aligned with the rotational axis of the roller 10. The shaft 14 is fixed in the roller 10 and is not rotatable with respect to the roller. It should be appreciated that the shaft 14 may be separate shafts fixed to the roller at each end or may be integrally formed with the roller 10.

The roller 10 can be incorporated into the image forming apparatus 1000 by replacing one of a sum of conventional rollers. Alternatively, the roller 10 can be incorporated as original equipment in the image forming apparatus 1000 as it is manufactured. According to exemplary embodiments of the invention, the roller 10 is placed in the image forming apparatus 1000 as part of the input transport mechanism 1100, the image forming engine transport mechanism 1210, or the output transport mechanism 1300. Thus, if the roller 10 is removed the image forming apparatus 1000 will malfunction. Tampering with the image forming apparatus 1000 by removing the roller 10 can thus be easily detected.

Figure 3:
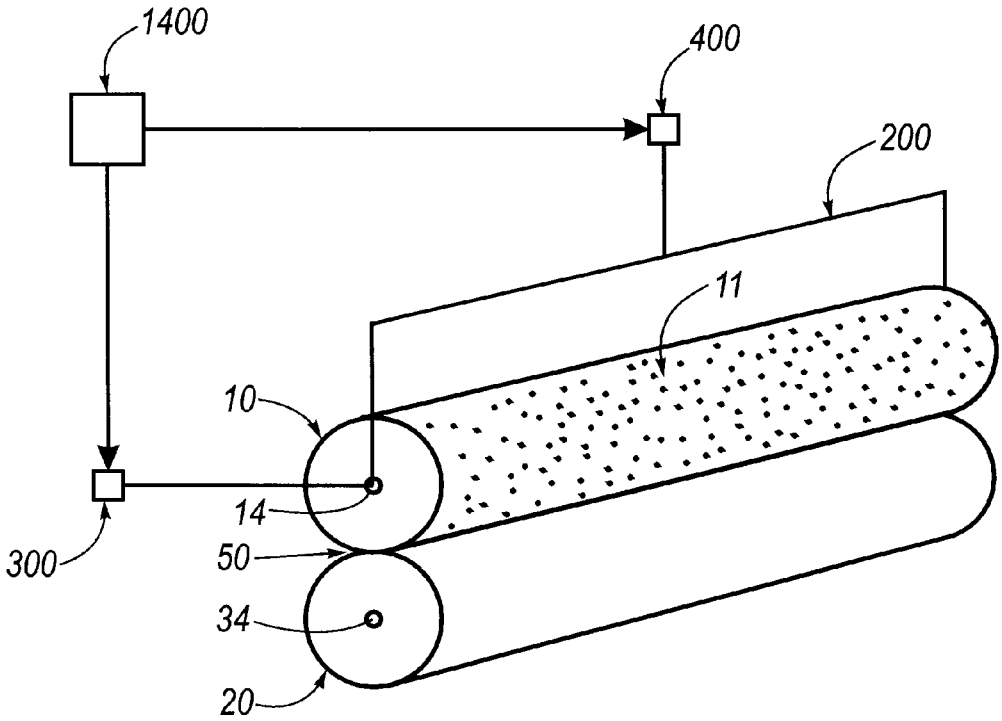
FIG. 3 is a perspective view of a pair of rollers including the roller of FIG. 1 of an image forming device according to this invention.

FIG. 3 is a perspective view of a first exemplary embodiment of a pair of rollers that includes the roller 10 and a second roller 20 that is in contact with the roller 10. A nip 50 is formed between the rollers 10 and 20. The roller 20 does not have a random pattern on its outer surface and is formed of, for example, rubber. The roller 10 is rotatably driven by a drive 300. The roller 10 is supported at both ends by a support 200. An actuator 400 pushes the support 200 toward the nip 50. The drive 300 and the actuator 400 are controlled by the controller 1400. As a sheet of recording material passes through the nip 50, the roller 10 applies the random pattern to the sheet of recording material by imprinting, embossing, and/or piercing the sheet of recording material. If the random pattern on the outer surface 11 of the roller 10 includes rounded grains, the random pattern will be imprinted or embossed onto the sheet of recording material. If the random pattern on the outer surface 11 of the roller 10 includes sharp splinters, the sharp splinters will pierce the sheet of recording material and form the pattern as small, detectable holes in the sheet of recording material.

The pressure of the roller 10 against the roller 20 applied by the actuator 400 can be programmed and controlled by the controller 1400. A value representing the pressure applied by the actuator can be stored in the memory 1410 of the controller 1400. The random pattern applied to the sheet of recording material can be registered by passing a pressure sensitive sheet of recording material through the nip 50. The random pattern applied to the sheet of recording material can be determined by any known forensic technique. For example, an inked roller may be passed over the pressure sensitive sheet of recording material having the random pattern. No ink will be applied to the document where the imprinting, embossing, or holes of the pattern have been formed. The resulting image can be scanned and stored in an image database. The database can be cataloged and indexed to allow easy identification of a sheet or sheets of recording material of unknown origin.

It is also possible to use a scanning electron micrograph for forming an image of the random pattern applied to the sheet of recording material. The image formed by the scanning electron micrograph can be stored in the image database. A sheet of recording material produced by an image forming apparatus that includes the roller 10 can be easily traced to that image forming apparatus and/or verified as having been produced by that image forming apparatus by using any known forensic technique to determine if the sheet of recording material contains the random pattern produced by the roller 10.

The roller 20 does not include a random pattern on its outer surface. Thus a sheet of recording material that passes through the nip 50 between the rollers 10 and 20 will have the random pattern formed only on one side. Even if the roller 10 were removed from the image forming apparatus that was used to initially form an image on that sheet or recording material and placed in another image forming apparatus in an attempt to create a forged image on a different sheet of recording material, the forgery would not be possible unless the roller 10 is installed to create the same nip pressure as in the original image forming apparatus. If the roller 10 is installed at a different nip pressure, the nature, size, and degree of the impressions, embossings, or holes will differ from the pattern created by the original image forming apparatus and stored and indexed in the database.

Although the support 200 has been shown as pushed by the actuator 400 controlled by the controller 1400, it should also be appreciated that in various other exemplary embodiments of the systems and methods of the invention, the support 200 may be biased by a biasing member, for example, a spring, so that the control of the pressure of the roller 10 against the roller 20 is passive. It should also be appreciated that the support 200 may support the roller 20 and the support may be pushed by the actuator 400 or by a biasing member.

Figure 4:
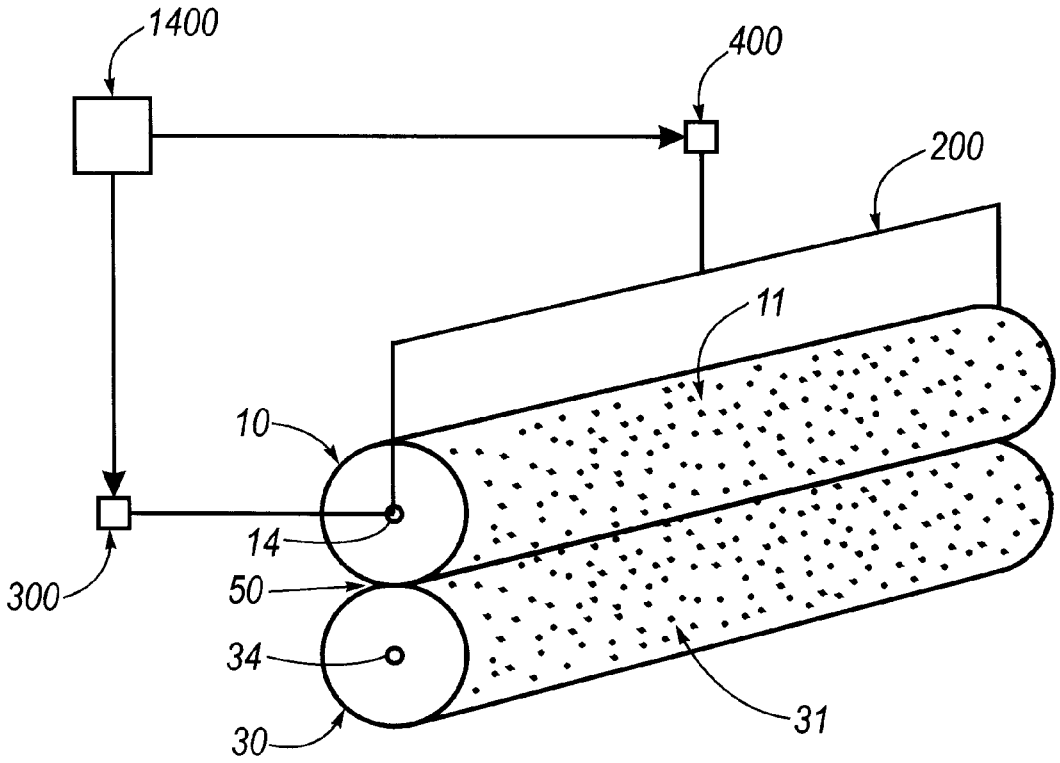
FIG. 4 is a perspective view of a pair of rollers including two of the rollers shown in FIG. 2.

FIG. 4 is a perspective view of a second exemplary embodiment of a pair of rollers according to this invention. In this second exemplary pair or rollers, the roller 10, having a first random pattern on its outer surface 11, is opposed to a roller 30 having a second random pattern on its outer surface 31. The roller 30 includes a shaft 34 generally aligned with the rotational axis of the roller 30. A nip 50 is formed between the rollers 10 and 30. As in the first exemplary embodiment of the pair of rollers shown in FIG. 3, the nip pressure between the rollers 10 and 30 is applied by the actuator 400 through the support 200. The pressure applied by the actuator 400 can be controlled by the controller 1400. The roller 10 applies the first random pattern to one side of the sheet of recording material and the roller 30 applies the second random pattern to the other side of the sheet of recording material. The first and second random patterns on the sheet of recording material formed by the rollers 10 and 30 on the sheet of recording material can be imaged and stored in an image database. The database can be cataloged and indexed to allow a sheet of recording material to be identified and/or verified sheet of recording material. As in the first exemplary embodiment of the part of rollers 10 and 20, even assuming the rollers 10 and 30 could be removed from the original image forming apparatus in which they were installed and placed into another image forming apparatus, it would not be possible to create a forged image on a different sheet of recording material unless the rollers 10 and 30 were reinstalled into a second image forming apparatus in the same relationship as in the original image forming apparatus and at the same nip pressure as in the original image forming apparatus.

As in the first exemplary embodiment shown in FIG. 3, it should be appreciated that the support 200 may be biased by a biasing member so that control of the pressure between the rollers 10 and 30 is passive and that the support 200 may support roller 30.

Figure 5:
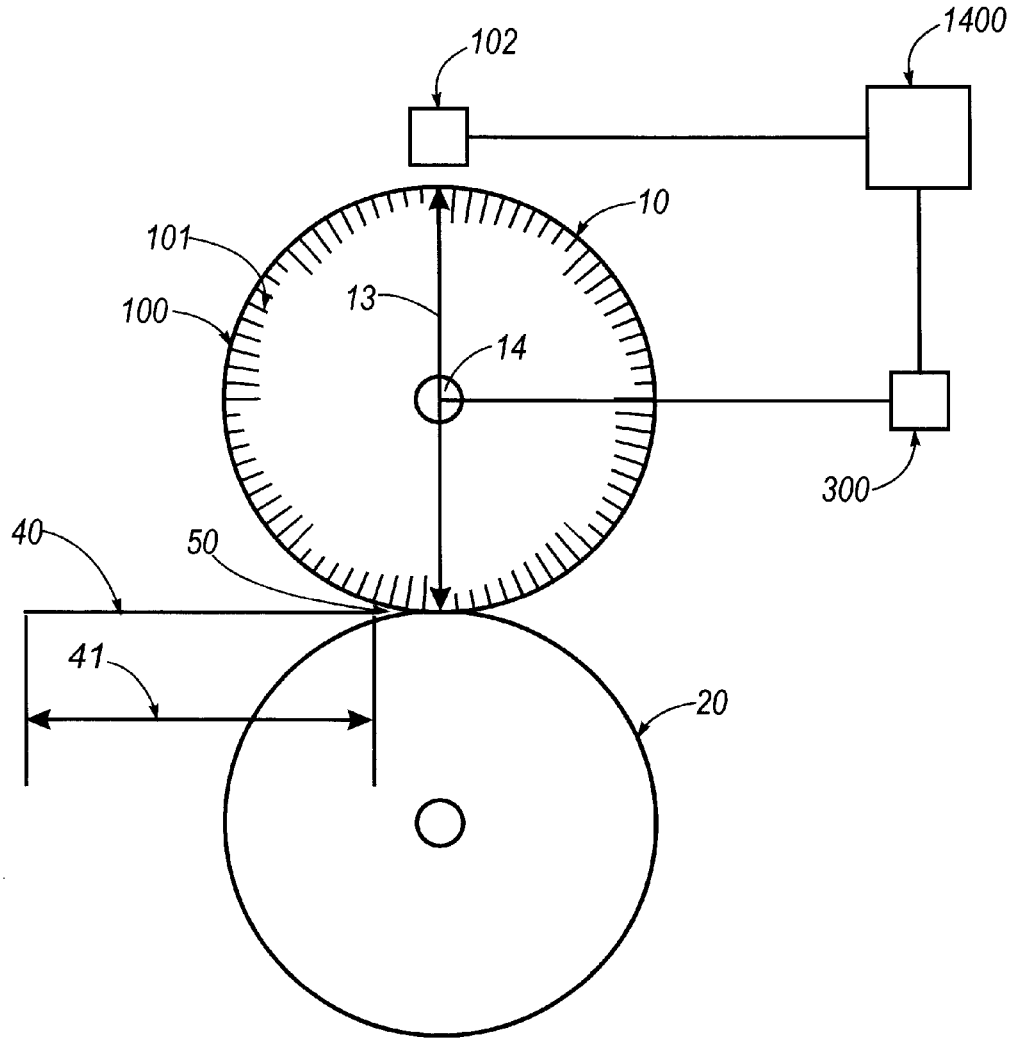
FIG. 5 is a side plan view of a pair of rollers as shown in FIG. 3 illustrating the relationship between the circumference of the roller and the length of a sheet of recording material.

FIG. 5 is a side plan view of a pair of rollers as shown in FIG. 3 illustrating the relationship between the circumference of the roller 10 and the length 41 of a sheet of recording material 40. As shown in FIG. 5, the roller 10 having the first random pattern on its outer surface contacts the roller 20 to form the nip 50. In an exemplary embodiment, the diameter 13 of the roller 10 is such that the circumference of the roller 10 is larger than the length 41 of the sheet of recording material 40 that passes through the nip 50. Because the circumference of the roller 10 is larger than the length 41 of the sheet of recording material 40, only a portion of the random pattern on the outer surface 11 of the roller 10 is applied to the sheet of recording material 40. A rotary encoder 100 is provided at one end of the roller 10. In various exemplary embodiments, the rotary encoder 100 is a physically independent rotary encoder device mounted on the shaft 14 that passes through the roller 10. The rotary encoder 100 includes a scale member 101 that rotates past a read head member 102. In other exemplary embodiments, the rotary encoder 100 can use a portion of the roller 10 as the scale member 101.

The position of the scale member 101 when the roller 10 first contacts the sheet of recording material 40 is detected by the read head member 102 and sent to the controller 1400. The roller 10 can be indexed by the drive 300 under the control of the controller 1400 to contact the sheet of recording material 40 at the same position of the scale member 101 for each sheet of recording material 40 in a series of sheets of recording material. Alternatively, the roller 10 may contact each sheet of recording material 40 in a series of sheets of recording material at a different position of the scale member 101. Even assuming the roller 10 could be removed from the original image forming apparatus in which it was installed, it would not be possible to create forged sheets of recording material unless the roller were reinstalled into a second image forming apparatus and caused to contact the sheet or sheets of recording material at the same position of the scale member 101 as in the original image forming apparatus.

In another exemplary embodiment, the diameter 13 of the roller 10 may be such that the circumference of the roller 10 is smaller than the length 41 of the sheet of recording material 40 so that the random pattern on the outer surface 11 of the roller 10 is applied more than once to the sheet of recording material 40.

Although the roller 20 is shown in FIGS. 3 and 5 as having the same diameter as the roller 10, it should also be appreciated that the roller 20 may have any diameter.

Figure 6:
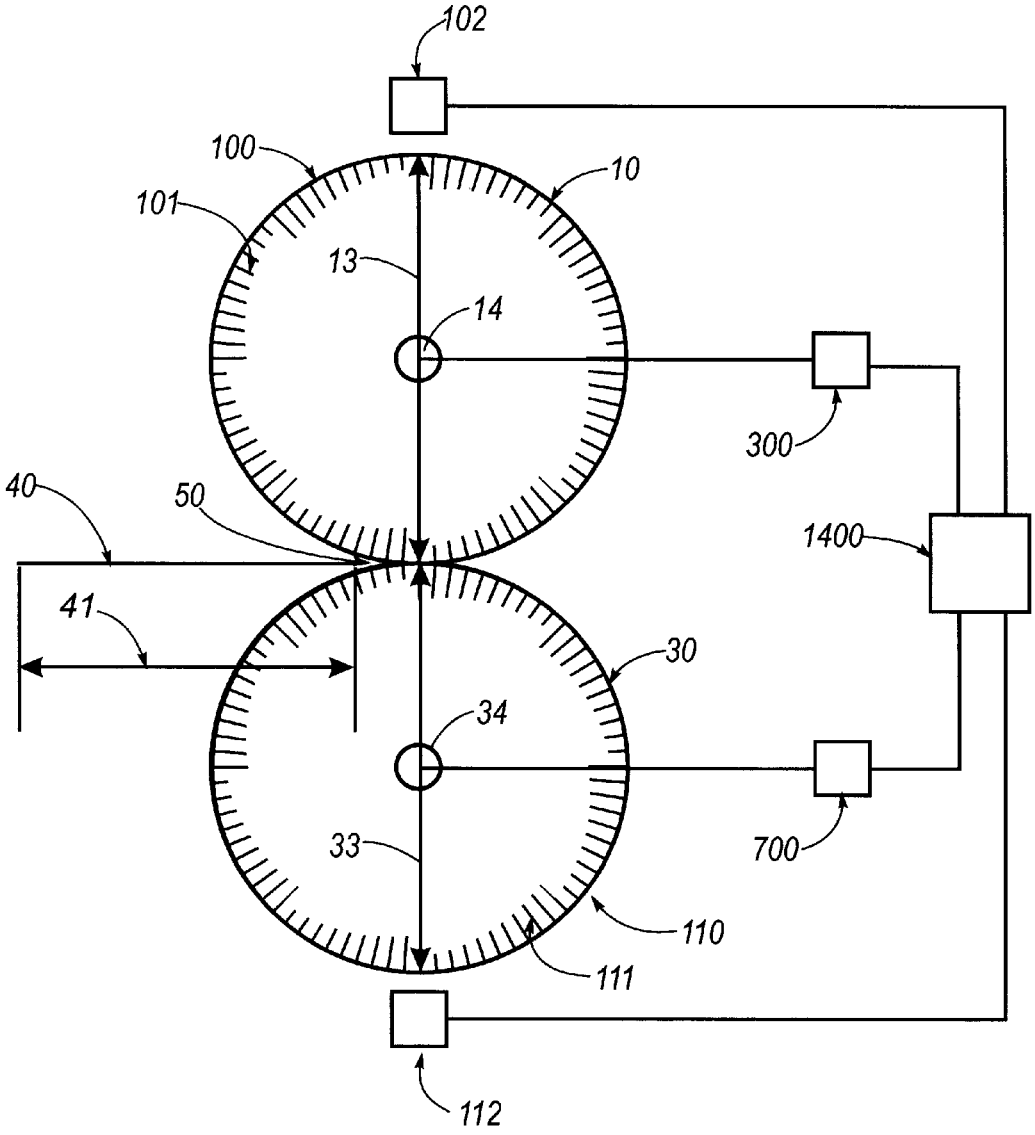
FIG. 6 is a side plan view of a pair of rollers as shown in FIG. 4 illustrating the relationship between the circumference of the rollers and the length of a sheet of recording material.

FIG. 6 is a side plan view of a pair of rollers as shown in FIG. 4 illustrating the relationship between the circumferences of the rollers 10 and 30 and the length 41 of the sheet of recording material 40. As shown in FIG. 6, the roller 10 having the first random pattern on its outer surface forms the nip 50 with the roller 30 having the second random pattern on its outer surface 31. The roller 30 is rotatably driven by a drive 700. A rotary encoder 110 is provided at one end of the roller 30. The rotary encoder 110 includes a scale member 111 that rotates past a read head member 112. The diameters 13 and 33 of the rollers 10 and 30, respectively, are such that the circumferences of the rollers 10 and 30 are larger than the length 41 of the sheet of recording material 40. It should also be appreciated that the circumferences of the rollers 10 and 30 may be smaller than the length 41 of the sheet of recording material 40.

The positions of the scale members 101 and 111 as the sheet of recording material 40 first contacts the rollers 10 and 30, respectively, are detected by the read head members 102 and 112, respectively, and sent to the controller 1400. The rollers 10 and 30 can be indexed by the drives 300 and 700, respectively, under the control of the controller 1400 to contact the sheet of recording material 40 at the same positions of the scale members 101 and 111, respectively, for each sheet of recording material 40 in a series of sheets of recording material to be created. Alternatively, the rollers 10 and 30 may contact each sheet of recording material 40 in a series of sheets of recording material at different positions of the scale members 101 and 111, respectively. Even assuming the rollers 10 and 30 could be removed from the original image forming apparatus in which they installed, it would not be possible to create forged sheets of recording material unless the rollers were reinstalled into a second image forming apparatus in the same relationship and caused to contact the sheet or sheets of recording material at the same positions of the scale members 101 and 111 as in the original image forming apparatus.

Although the rollers 10 and 30 are shown in FIGS. 4 and 6 as having equal diameters, it should be appreciated that the rollers 10 and 30 may have different diameters so that each roller 10 and 30 has a different circumference that is larger or smaller than the length 41 of the sheet of recording material 40. It should also be appreciated that the roller 10 may have a circumference smaller than the length 41 of the sheet of recording material 40 while the roller 30 has a circumference larger than the length 41 of the sheet of recording material 40, and vice versa.

Figure 7:
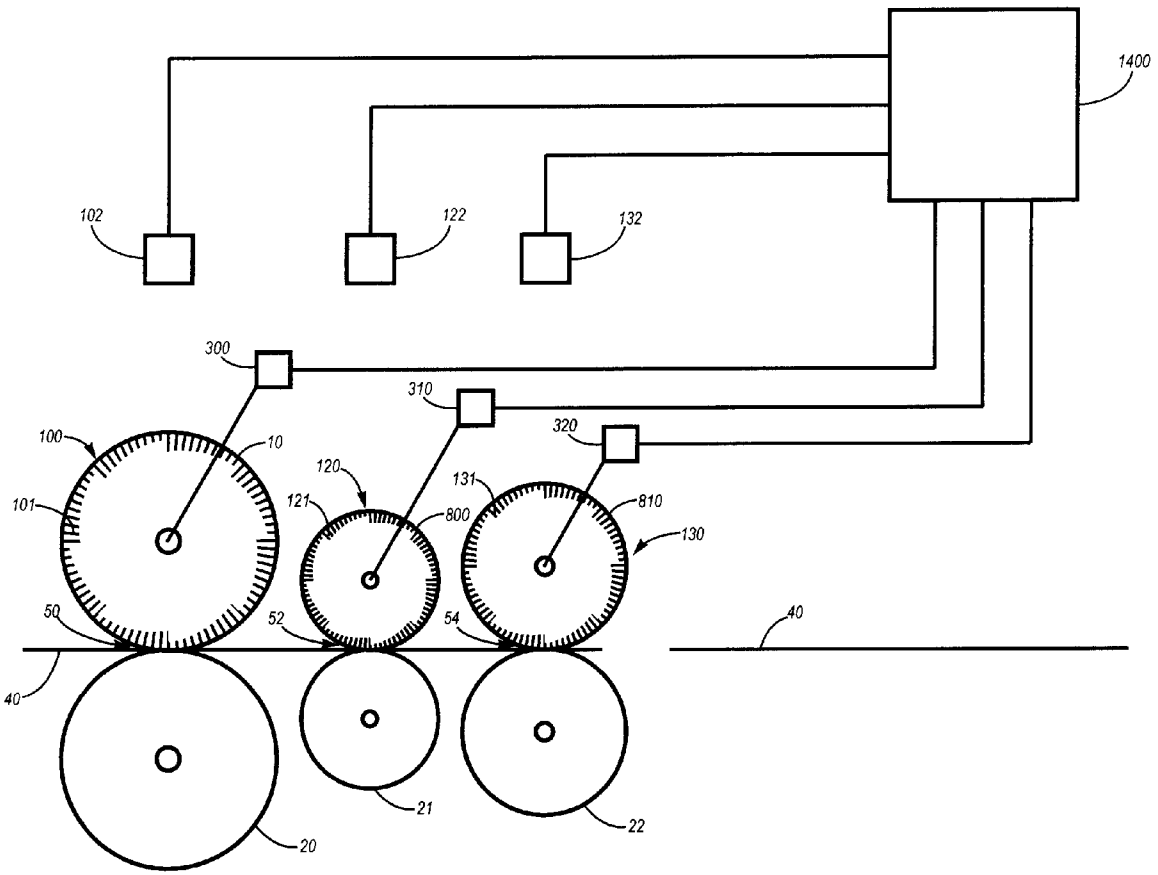
FIG. 7 is a side plan view of a plurality of pairs of rollers including the pair of rollers shown in FIG. 3 that apply a plurality of phase-shifted random patterns to a sheet of recording material.

FIG. 7 is a side plan view of a plurality of pairs of rollers including the first pair of rollers 10 and 20. As shown in FIG. 7, the rollers 10 and 20 form the nip 50. A roller 800 having a random pattern on its outer surface and a rotary encoder 120 including a scale member 121 at one end forms a nip 52 with a roller 21. The roller 21 does not have a random pattern on its outer surface. The position of the scale member 121 as a sheet of recording material 40 first contacts the roller 800 is read by a read head member 122 and sent to the controller 1400. A roller 810 having a random pattern on its outer surface and a rotary encoder 130 including a scale member 131 at one end forms a nip 54 with a roller 22. The roller 22 does not have a random pattern on its outer surface. The position of the scale member 131 as the sheet of recording material 40 first contacts the roller 810 is read by a read head member 132 and sent to the controller 1400. The rollers 800 and 810 are rotatably driven by drives 310 and 320, respectively, that are controlled by the controller 1400.

As the sheet of recording material 40 passes through the nips 50 and 52 and 54 the rollers 10 and 800 and 810, respectively, apply the random patterns to the sheet of recording material 40. The random patterns are phase shifted relative to one another on the sheet of recording material 40. The position of each scale member 101 and 121 and 131 as each roller 10 and 800 and 810, respectively, contacts the sheet of recording material 40 is detected by the read head members 102 and 122 and 132, respectively, and sent to the controller 1400. The position of each scale member 101 and 121 and 131 establishes a sequence code of the phase shift of the random patterns applied by each roller 10 and 800 and 810, respectively.

The drives 300 and 310 and 320 of the rollers 10 and 800 and 810, respectively, may be controlled by the controller 1400 so that each roller 10 and 800 and 810 contacts each sheet of recording material 40 in a series of sheets of recording material at the same position of the scale members 101 and 121 and 131, respectively. Each sheet of recording material 40 would thus have the same sequence code. Alternatively, the rollers 10 and 800 and 810 may contact each sheet of recording material 40 in a series of sheets of recording material at different positions of the scale members 101 and 121 and 131, respectively, so that each document in the series of documents will have a unique sequence code.

Even assuming the rollers 10 and 800 and 810 could be removed from the original image forming apparatus in which they installed, it would not be possible to create forged sheets of recording material unless the rollers 10 and 800 and 810 were reinstalled into a second image forming apparatus in the same relationship and caused to contact the sheet or sheets of recording material at the same positions of the scale members 101 and 121 and 131, respectively, as in the original image forming apparatus.

The diameter and circumference of each roller 10 and 800 and 810 differs from the other rollers. The circumferences of the rollers 10 and 800 and 810 are relatively prime to each other. In other words, the only integer commonly divisible into the circumferences of the rollers 10 and 800 and 810 is 1. For example, the circumference of roller 10 may be 7, the circumference of the roller 800 may be 5 and the circumference of the roller may be 6. Although three rollers 10 and 800 and 810 are shown, it should be appreciated that any number of rollers greater than one may be used to apply a plurality of random, phase shifted patterns to the sheet of recording material 40 as long as the circumferences of the rollers are different from each other and are relatively prime to one another. It should also be appreciated that each roller 20 and 21 and 22 may have any diameter.

Figure 8:
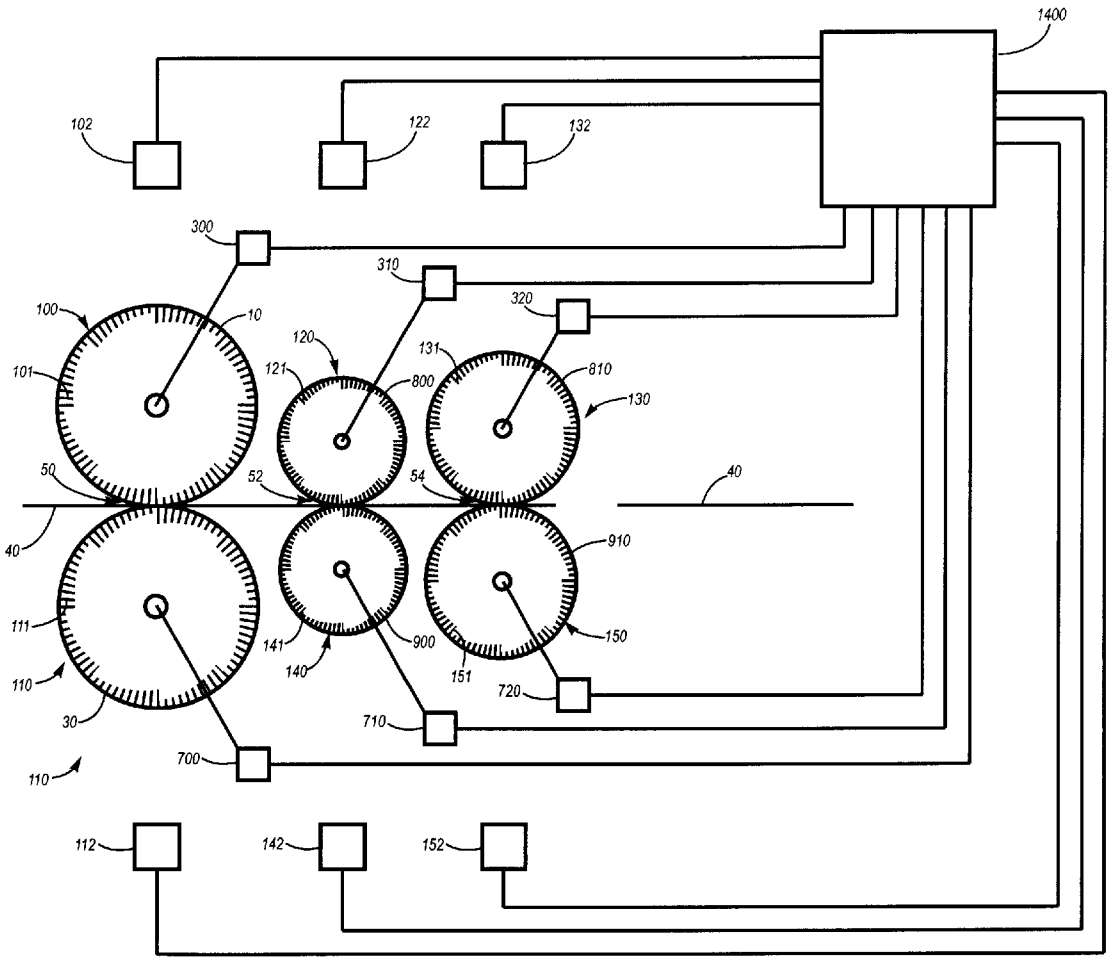
FIG. 8 is a side plan view of a plurality of pairs of rollers including the pair of rollers as shown in FIG. 4 that apply a plurality of phase-shifted random patterns to a sheet of recording material.

FIG. 8 is a side plan view of a plurality of pairs of rollers including the rollers 10 and 800 and 810. The roller 10 forms the nip 50 with the roller 30. The roller 800 forms the nip 52 with a roller 900 having a random pattern on its outer surface and a rotary encoder 140 having a scale member 141 at one end. The roller 900 is rotatably driven by a drive 710. The position of the scale member 141 as the roller 900 first contacts the sheet of recording material 40 is read by a read head member 142 and sent to the controller 1400. The roller 810 forms the nip 54 with a roller 910 having a random pattern on its outer surface and a rotary encoder 150 having a scale member 151 at one end. The roller 910 is rotatably driven by a drive 720. The position of the scale member 151 as the roller 910 first contacts the sheet of recording material 40 is read by a read head member 152 and sent to the controller 1400.

As the sheet of recording material 40 passes through each nip 50 and 52 and 54, the random patterns of the rollers 10 and 800 and 810 are applied to one side of the sheet of recording material 40 in a phase shifted relationship and the random patterns of the rollers 30 and 900 and 910 are applied to the other side of the sheet of recording material 40 in a phase shifted relationship. The position of the scale members 101 and 121 and 131 when the sheet of recording material 40 first contacts the rollers 10 and 800 and 810, respectively, establishes a sequence code for the first side of the sheet of recording material 40. The position of the scale members 111 and 141 and 151 as the rollers 30 and 900 and 910 first contact the sheet of recording material 40 establishes a sequence code for the other side of the sheet of recording material 40. The rollers 10 and 800 and 810 may be indexed to contact each sheet of recording material 40 in a series of sheets of recording material at the same position of the scale members 101 and 121 and 131, respectively, so that each sheet of recording material in a series of sheets or recording material has the same sequence code on the first side. The rollers 30 and 900 and 910 may be similarly indexed so that each sheet or recording material 40 in a series of sheets of recording material has the same sequence code on the other side of the sheet of recording material. Alternatively, the rollers 10 and 30 and 800 and 900 and 810 and 910 may contact each sheet of recording material 40 in a series of sheets of recording material at different positions of the scale members 101 and 111 and 121 and 141 and 131 and 151, respectively, so that each sheet of recording material 40 in the series has a unique sequence code on each side of the sheet of recording material 40.

Even assuming the rollers 10 and 30 and 800 and 900 and 810 and 910 could be removed from the original image forming apparatus in which they installed, it would not be possible to create forged sheets of recording material unless the rollers 10 and 30 and 800 and 900 and 810 and 910 were reinstalled into a second image forming apparatus in the same relationship and caused to contact the sheet or sheets of recording material at the same positions of the scale members 101 and 111 and 121 and 141 and 131 and 151, respectively, as in the original image forming apparatus.

Although the rollers of each pair of rollers 10 and 30 and 800 and 900 and 810 and 910 have been shown as having equal diameters, respectively, it should be appreciated that the diameters of the rollers of each pair of rollers may be unequal as long as the circumferences of the rollers on one side of the sheet of recording material 40 are relatively prime to each other and the circumferences of the rollers on the other side of the sheet of recording material 40 are relatively prime to each other. It should also be appreciated that although three pairs of rollers have been shown forming three nips, any number of pairs of rollers greater than one forming any number of nips greater than one may be used to apply random, phase shifted patterns to both sides of a sheet of recording material.

Figure 9:
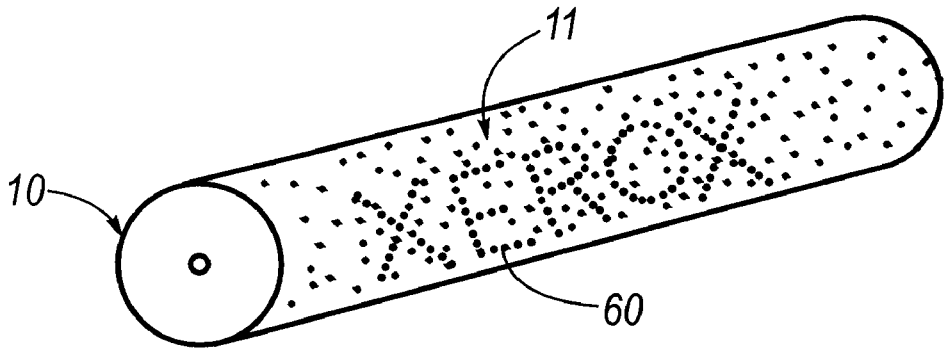
FIG. 9 is a perspective view of a second exemplary embodiment of a roller including a first exemplary embodiment of a random pattern and a non-random pattern.

FIG. 9 is a perspective view of one exemplary embodiment of a roller 10 having a random pattern and a non-random pattern on its outer surface 11 according to this invention. The roller 10 includes the random pattern on its outer surface 11. The roller 10 also includes a non-random pattern 60 on its outer surface 11 extending in a longitudinal direction of the roller 10. The non-random pattern can represent a trademark or a mark of authenticity. The non-random pattern 60 can also simplify the verification of the random pattern applied to the sheet of recording material 40 by the roller 10 by providing alignment points when comparing the sheet of recording material to the image of the random pattern stored and cataloged in the database.

Figure 10:
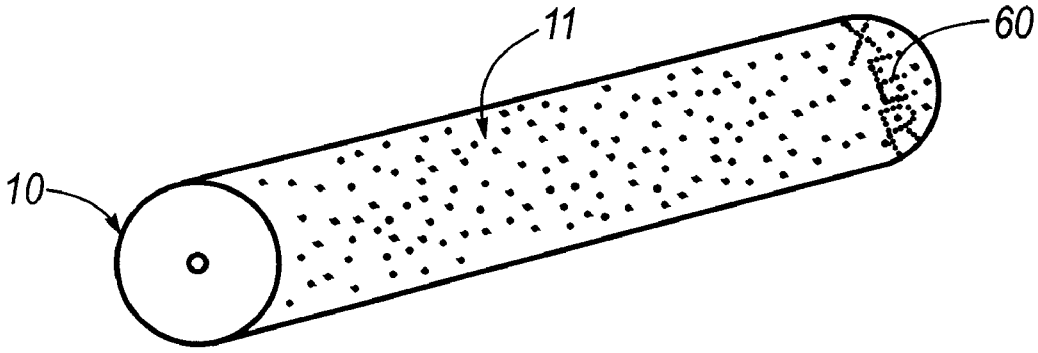
FIG. 10 is a perspective view of a roller including a second exemplary embodiment of a random pattern and a non-random pattern.

FIG. 10 is a perspective of another exemplary embodiment of a roller 10 having a random pattern and a non-random pattern 60 according to the invention. The non-random pattern 60 extends in a circumferential direction of the roller 10.

Figure 11:
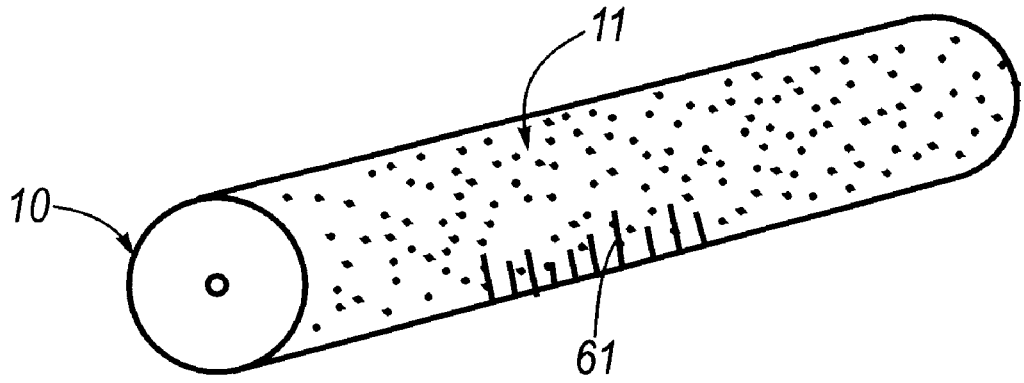
FIG. 11 is a perspective view of a roller including a third exemplary embodiment of a random pattern and a non-random pattern.

FIG. 11 is a perspective view of a second exemplary embodiment of a roller 10 having a random pattern and a non-random pattern on its outer surface according to this invention. The roller 10 includes the random pattern on its outer surface 11. The roller 10 also includes a non-random pattern 61 on its outer surface 11 extending in a longitudinal direction of the roller 10. The non-random pattern 61 produces impressions or embossings or holes in the document. The impressions or embossings or holes formed by the non-random pattern 61 produce a unique sound when an object such as a fingernail, paper clip, pen or pencil is rubbed across the impressions or embossings or holes.

Figure 12:
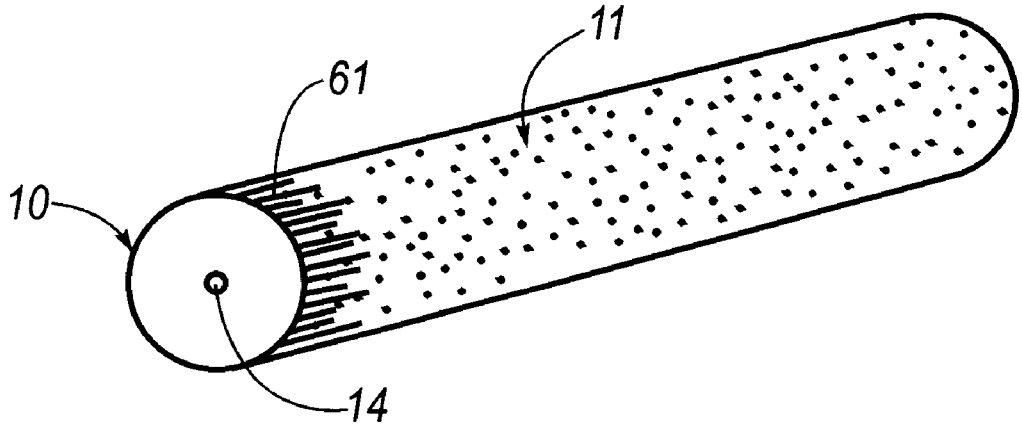
FIG. 12 is a perspective view of a roller including a fourth exemplary embodiment of a random pattern and a non-random pattern.

FIG. 12 is a perspective view of another exemplary embodiment of a roller 10 having a random pattern and a non-random pattern on its outer surface according to this invention. The roller 10 includes the random pattern on its outer surface 11. The roller 10 also includes a non-random pattern 61 on its outer surface 11 extending in a circumferential direction of the roller 10. The non-random pattern 61 produces impressions or embossings or holes in the document. The impressions or embossings or holes formed by the non-random pattern 61 produce a unique sound when an object such as a fingernail, paper clip, pen or pencil is rubbed across the impressions or embossings or holes.

Although the non-random pattern has been shown as extending in either the longitudinal or circumferential direction, it should be appreciated that the non-random pattern may extend in any direction, for example, helically, on the outer surface of the roller. It should also be appreciated that a plurality of non-random patterns may be applied to an outer surface of the roller in addition to the random pattern and that the non-random pattern or patterns may be provided anywhere on the outer surface of the roller.

Although the random pattern or patterns have been shown as being applied to a sheet of recording material as it travels in a transport direction through a nip formed by at least one roller including a random pattern on its outer surface, it should be appreciated that the random pattern may be applied to the sheet of recording material in a direction transverse to the transport direction of the sheet of recording material. It should also be appreciated that sheets of recording material may be formed of any material that can be imprinted, embossed, or pierced to include the random pattern or patterns. It should also be appreciated that the width of the roller may be equal to, larger than, or smaller than a width of a sheet of recording material.

It should be understood that the controller 1400 shown in FIGS. 1 and 3–10 can be implemented as portions of a suitably programmed general purpose computer. Alternatively, the control circuit can be implemented as physically distinct hardware circuits within an ASIC, or using a FPGA, a PDL, a PLA or a PAL, or using discrete logic elements or discrete circuit elements. The particular form the control circuit shown in FIGS. 1 and 3–10 will take is a design choice and will be obvious and predictable to those skilled in the art.

As shown in FIG. 1, the memory 1410 may be implemented using an alterable volatile and/or non-volatile memory and/or non-alterable memory. However, the memory 1410 can also be implemented using a PROM, an EPROM, an optical ROM disk, such as a CD-ROM or DVD-ROM, and disk drive or the like.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and the scope of the invention.

What is claimed is:

1. A system for tagging a sheet of recording material, comprising:

a first roller;

a second roller forming a nip with the first roller;

wherein at least one roller of the first roller and the second roller includes a random pattern on an outer surface thereof that applies at least a portion of the random pattern to at least one side of the sheet of recording material passing through the nip, and a memory device for storing the random pattern applied to each at least one side of the sheet of recording material for identification of each sheet.

2. The system according to claim 1 wherein a circumference of the at least one roller is smaller than a length of the sheet of recording material.

3. The system according to claim 1 wherein a circumference of the at least one roller is larger than a length of the sheet of recording material passing through the nip.

4. The system according to claim 1 further comprising a controller that determines a point on the at least one roller at which the at least one roller first contacts the sheet of recording material.

5. The system according to claim 4, wherein the controller controls the at least one roller to first contact each sheet of recording material in a series of sheets of recording material at the same point on the at least one roller for each sheet of recording material in the series.

6. The system according to claim 1 wherein said at least a portion of the random pattern is applied to the sheet of recording material by at least one of imprinting, embossing or piercing.

7. An image forming device including the system of claim 1.

8. A method of tagging a sheet of recording material, comprising:

passing the sheet of recording material through a nip formed by two rollers;

applying at least a portion of a random pattern formed on an outer surface of at least one roller of said two rollers to at least one side of the sheet of recording material; and storing the applied random pattern in association with each sheet passed through the nip.

9. The method according to claim 8, further comprising:

determining a point on the at least one roller at which the at least one roller first contacts the sheet of recording material.

10. The method according to claim 9, further comprising:

controlling the at least one roller to first contact each sheet of recording material in a series of sheets of recording material at the same point on the at least roller.

11. The method according to claim 8, wherein said applying at least a portion of the random pattern includes at least one of imprinting, embossing, and piercing the sheet of recording material.

12. A system for tagging a sheet of recording material, comprising:

a plurality of pairs of rollers, each pair of rollers forming a nip through which the sheet of recording material passes, wherein a plurality of rollers on at least one side of the sheet of recording material have unique random patterns on outer surfaces thereof that apply the random patterns to the sheet of recording material in a phase shifted relationship; and a memory device for storing the unique random patterns applied to the sheet of recording material by each pair of the plurality of pairs of rollers.

13. The system according to claim 12, further comprising:

a controller that determines each point on each roller of the plurality of rollers having unique random patterns where each roller first contacts the sheet of recording material.

14. The system according to claim 13, wherein the controller controls each roller of the plurality of rollers having unique random patterns to first contact a sheet of recording material in a series of sheets of recording material at the same point on said each roller for each sheet of recording material in the series.

15. An image forming device including the system of claim 12.

16. A method of tagging a sheet of recording material, comprising:

passing the sheet of recording material through a plurality of nips formed by a plurality of pairs of rollers; and applying a plurality of random patterns, each random pattern formed on a respective roller of a plurality of rollers on at least one side of the sheet of recording material, to the sheet of recording material in a phase shifted relationship; and storing the applied random pattern in association with each sheet passed through the nip.

17. The method according to claim 16, further comprising:

determining each point on each respective roller at which each respective roller first contacts the sheet of recording material.

18. The method according to claim 17, further comprising:

controlling each respective roller to first contact each sheet of recording material in a series of sheets of recording material at the same point on each respective roller.

19. The method according to claim 16, wherein said applying the plurality of random patterns includes at least one of imprinting, embossing and piercing the sheet of recording material.

* * * * *